United States Patent [19]

Verreet

[11] Patent Number: 4,827,708

[45] Date of Patent: May 9, 1989

[54] WIRE ROPE

[75] Inventor: Roland Verreet, Aachen, Fed. Rep. of Germany

[73] Assignee: Drahtseilwerk Saar GmbH, Fed. Rep. of Germany

[21] Appl. No.: 99,475

[22] Filed: Sep. 22, 1987

[30] Foreign Application Priority Data

Sep. 23, 1986 [DE] Fed. Rep. of Germany ..... 3632298

[51] Int. Cl.[4] ..... D07B 1/06

[52] U.S. Cl. ..... 57/212; 57/206; 57/207; 57/231

[58] Field of Search ..... 57/200, 206, 207, 210, 57/212, 213, 218, 230, 231, 316, 221, 223

[56] References Cited

U.S. PATENT DOCUMENTS

| | | | |
|---|---|---|---|
| 861,230 | 7/1907 | Allan | 57/206 X |
| 1,786,936 | 12/1930 | Craig | 57/206 X |
| 2,181,344 | 11/1939 | Rick | 57/211 |
| 2,407,634 | 9/1946 | Du Pont | 57/206 X |
| 2,562,340 | 7/1951 | Stanton | 57/213 |
| 4,365,467 | 12/1987 | Pellow | 57/213 X |

*Primary Examiner*—Donald Watkins

*Attorney, Agent, or Firm*—Peter K. Kontler

[57] ABSTRACT

A wire rope is constructed so that the twisting moment generated in the rope per unit load decreases from one end of the rope to the other . This is accomplished by varying the length of lay along the rope.

8 Claims, 4 Drawing Sheets

WIRE ROPE

The invention relates to a wire rope for suspended use over a great height difference, in particular a wire rope the bottom end of which is secured such that it is prevented from turning, in particular a mining cable, marine cable or suspension cable.

It is the object of the invention to increase the structural stability of such a wire rope.

According to the invention this object is achieved by changing the length of lay over the rope length in such a way that the load-specific twisting moment of the wire rope decreases towards the top.

This will be explained as follows:

In a wire rope the strands lie in a helix, i.e. at an angle to the longitudinal direction of the wire rope. If a tractive force acts on the wire rope, this acts in the longitudinal direction. It tries to pull the strands into the longitudinal direction, i.e. to untwist them. As a result thereof there occurs in a strand layer a twisting moment of $$m=k\cdot p\cdot d$$

(m=twisting moment; k=constant factor; p=longitudinal force acting in the strand layer; d=strand layer diameter). The factor k includes a conversion factor longitudinal force—tangential force, which depends on the angle of the strands and other design criteria. The greater the angle of the strands, i.e. the smaller the "length of lay" in relation to the diameter d, the greater this conversion and, therefore, the factor k, and the greater the twisting moment m at constant p.

With a wire rope which has only one layer of strands on a hemp core, the tractive force acting on the rope is exactly the same as the tractive force acting on the layer of strands. With a wire rope which comprises a center strand and a plurality of strand layers, the tractive force is distributed substantially over the strand layers; the force on the center strand is small.

At the bottom end of the wire rope the tractive force acting on the wire rope is equal to the useful load while the tractive force on the length of wire rope that hangs down is equal to the useful load plus the mass of that section of the wire rope below the position in question. This means: with the present wire ropes the twisting moment m of the wire rope increases from the bottom end of the wire rope towards the top. There exists no equilibrium of the twisting moments over the length of the wire rope. This results in twisting phenomena inside the rope structure until a state of equilibrium is reached. In the upper part of the wire rope, where the twisting moment is greater than in the bottom part, there exists a greater tendency to untwist than in the bottom part. This causes an untwisting in the top part while the bottom part twists further until a state of equilibrium is reached. The untwisting in the top part causes the rope structure there to loosen. When the rope runs over rope pulleys or is wound onto drums, this causes longitudinal displacements inside the rope. On the whole damage occurs which shortens the service life.

The invention is based on this finding and remedies the situation in that the increase in the twisting moment M towards the top is counter-acted by a change in the rope structure towards the top, which towards the top reduces the load-specific twisting moment M/kp, i.e. the twisting moment produced per unit load.

This is possible by changing the length of lay over the rope length, which can be done in various ways and according to three different basic principles:

The first basic principle is to reduce, in the equation $m=k\cdot p\cdot d$, the factor k—see the foregoing explanations—by increasing the length of lay of the strand layer(s) towards the top.

This basic principle can be applied to wire ropes which have only one strand layer and to those which have several strand layers with the same direction of lay; in the latter case, in addition to the outer strand layer, also the inner strand layer, or if there are several inner strand layers at least the next inner strand layer, must have a length of lay which increases towards the top. The basic principle can also be applied when the wire rope has one or several inner strand layers, some or all of which have a reversed direction of lay in relation to the outer strand layer(s), but which because of the dimensions and/or the construction has/have a neutral turning behaviour incapable of producing a substantial twisting moment.

The second basic principle is to relieve the load on the outer strand layer(s) towards the top whilst increasing the load on the rest of the rope by increasing the elasticity of the outer strand layer(s), possibly of two outer strand layers which are stranded in the same direction of lay, and/or by reducing the elasticity of the rest of the rope to thus reduce, in the equation $m=k\cdot p\cdot d$, the factor p for the outer strand layer(s), which because of its/their larger diameter mainly determines/determine the twisting moment of the wire rope.

This basic principle can as such only be applied when the aforementioned rest of the rope, due to a particularly low-twist construction, does not itself produce any substantial twisting moment, i.e. because of a reduction towards the top in the lengths of lay in the strands of the outer strand layer(s) and/or because of an increase in the lengths of lay in the strands of the rest of the rope which towards the top respectively increases and decreases the elasticity of the strands themselves.

Depending on the circumstances, this basic principle can, furthermore, be applied in opposition to the first basic principle by reducing the lengths of lay of the outer strand layer(s) towards the top, which increases the elasticity of the strand layer(s) towards the top, and therefore, by reducing the force absorption, has a reducing effect on the factor p, but at the same time increases the factor k according to the first mentioned basic principle. It depends on the rope structure as a whole which influence predominates and to what extent, therefore, the second basic principle of load relief can be applied in this way.

As is clear from the foregoing, the first basic principle of changing the force conversion determined by the length of lay and the angle of lay, competes with a load relief according to the second basic principle which, depending on the circumstances, may act at the same time. The basic principle of changing the force conversion determines, therefore, that such a load relief cannot take place to a substantial extent. This is the case with a single-layer rope with a fibre core or another sufficiently elastic core provided under the strand layer(s) in question. On the other hand, the basic principle of load relief requires a rope core under the strand layer(s) in question which aside from its neutral rotation behaviour is so much less elastic that it absorbs the extra load, and it must, has the metal cross-section required for this.

Always in competition with the first basic principle of changing the force conversion is the third basic principle, according to which a load displacement is effected from the outer strand layer or layers to at least the next inner strand layer which has a reversed direction of lay.

Because the elasticity of the outer strand layer(s) increases towards the top and/or the elasticity of the only or next inner strand layer decreases towards the top, as already indicated, the portion of the load absorbed by the outer strand layer(s), which because its/their metal cross-section and diameter exceed that of all other strand layers absorbs/absorb most of the load and produces/produce the twisting moment in the rope, decreases towards the top. The load displaced to the inner or next inner strand layer, which has a reversed direction of lay, towards the top increases the counter-twisting moment occurring in this strand layer. In that case the resultant twisting moment does not towards the top increase proportionally to the increase in the rope weight. It can be kept constant.

The same means are available as for second basic principle of the load relief of the outer strand layers:

The elasticity of the outer strand layer can be increased by reducing the length of lay of this strand layer. To achieve the desired effect, the effect of load displacement to the inner or next inner strand layer on the resultant twisting moment of the wire rope must in this case be greater than the effect of the increase in the factor k of the outer strand layer associated with the reduction in the length of lay, i.e. with the force conversion according to the first basic principle.

the elasticity of the inner or next inner strand layer can be reduced by increasing the length of lay of this strand layer. Also the effect of the resultant load displacement on the twisting moment of the wire rope—increase of p in the inner or next inner strand layer—must in this case, in order to achieve the desired effect, exceed the reduction of the factor k of this strand layer associated with the increase in the length of lay. Depending on the circumstances, this is quite well possible.

Instead of reducing or increasing the length of lay of the strand layer itself or in addition thereto, it is also possible to reduce or increase the length of lay of wire layers in the strands in question; this also will increase or reduce the elasticity.

It goes without saying that the basic principle of load displacement by a change of elasticity brought about between the outer strand layer and the first inner strand layer which has a reversed direction of lay, can only be applied when the inner or next inner strand layer is able, based on its dimensions and its construction, to produce a substantial twisting moment. If, for example, the inner strand layer forms part of a core the diameter of which is not more than a third of the rope diameter, then it must be ignored.

Finally it is proposed, as an advantageous embodiment of the invention, that the specific load absorption, in other words, the load distribution, in the rope cross-section be roughly uniform at the top end of the rope, and the relatively stronger loading of individual strand layers associated with the described load displacement take place in the lower parts of the wire rope where the load is less.

In order that a machine used to produce wire rope need not be converted for a continuous change in the length of lay, the length of lay in question can be changed stepwise.

In the following the invention will be explained in greater detail with reference to an exemplary embodiment.

In the drawing:

FIG. 1 shows a cross-section through a wire rope,

FIG. 2 shows a diagram in which the twisting moment or torque for the wire rope according to FIG. 1 is plotted in relation to the loading for various lay length factors, FIG. 3 shows a diagram in which the lay length factor is plotted in relation to the loading at constant twisting moment or torque, FIG. 4 illustrates the stranding of a wire rope with a single strand layer, FIG. 5 illustrates the stranding of a wire rope with more than one strand layer each having the same direction of lay, and FIG. 6 illustrates the stranding of a wire rope with at least two strand layers having opposite directions of lay.

The wire rope 1 consists, as can be noted from FIG. 1, of a center strand 2, an inner strand layer of six strands 3, a plastic covering 4 for the inner strand layer and an outer strand layer of ten strands 5 pressed into this covering 4. As can furthermore be noted from FIG. 1, the center strand 2 and the strands 3 and 5 are compacted; the strands 5 are parallel-lay strands.

The direction of lay of the two strand layers is different. Both strand layers are stranded in regular lay. The average filling factor is 0.68, the stranding factor 0.84 and the mass factor 0.86.

The nominal diameter—which is also the diameter of the outer strand layer consisting of the strands 5—is 26 mm, the overall metal cross-section 364.0 $mm^2$, the outer wire diameter 1.40 mm, the linear mass 310 kg/%m, the theoretical breaking load 72,800 kp, and the minimum breaking load 61,150 kp (nominal strength of the wires 1960N/$mm^2$).

The diameter of the core consisting of the center strand 2 and the strands 3 is 14.8 mm. The lay length factor (quotient of length of lay and diameter) of the core is 6.3. The core constitutes 30% of the overall metal cross-section of the wire rope.

The freely suspended rope length is taken as 800 m. The overall rope weight is 2.5 t. The cable safety factor must be 8. This results in an overall load of 9.1 t and a useful load 6.6 t, or a loading of the highest rope cross-section of at 12.5% and the lowest rope cross-section of at 9.1% of the theoretical breaking load.

The diagram of FIG. 2 shows the twisting moment or torque in the wire rope in dependence on the loading for various lengths of lay. The curves were ascertained by tests on four wire ropes of the construction shown in FIG. 1, which were stranded with different lengths of lay of the outer strand layer, i.e. with the lay length factors 7.7; 7.0; 6.5 and 5.9.

If the twisting moment is to be the same at any height of the wire rope, then the lengths of lay must always be adapted to the loading of the wire rope at the respective heights in such a way that a horizontal line is obtained in the diagram of FIG. 2. In the present example the maximum loading of 12.5% of the theoretical breaking load of the wire rope and the smallest tested length of lay, i.e. the lay length factor 5.9, were chosen as the starting point A. This results for the lowest loading of 9.1% in the point B positioned between 7.0 and 7.7, and correspondingly for intermediate loadings.

In FIG. 3 the diagram of FIG. 2 has been changed, together with an increase in scale, in such a way that for the line A–B the lay length factor is plotted in relation to the loading. For point B a lay length factor of approx. 7.3 is obtained. FIG. 3 also shows the rope length. The broken line indicates how for each point of the rope the desired lay length factor of the outer strands can be derived. This is how the rope according to FIG. 1 is constructed.

In the case of a stepwise change in the lay length factor, for example, the first 80 m of the wire rope are made with a lay length factor of 5.9, the second 80 m with a lay length factor of 6.06, etc.

Figure 1:
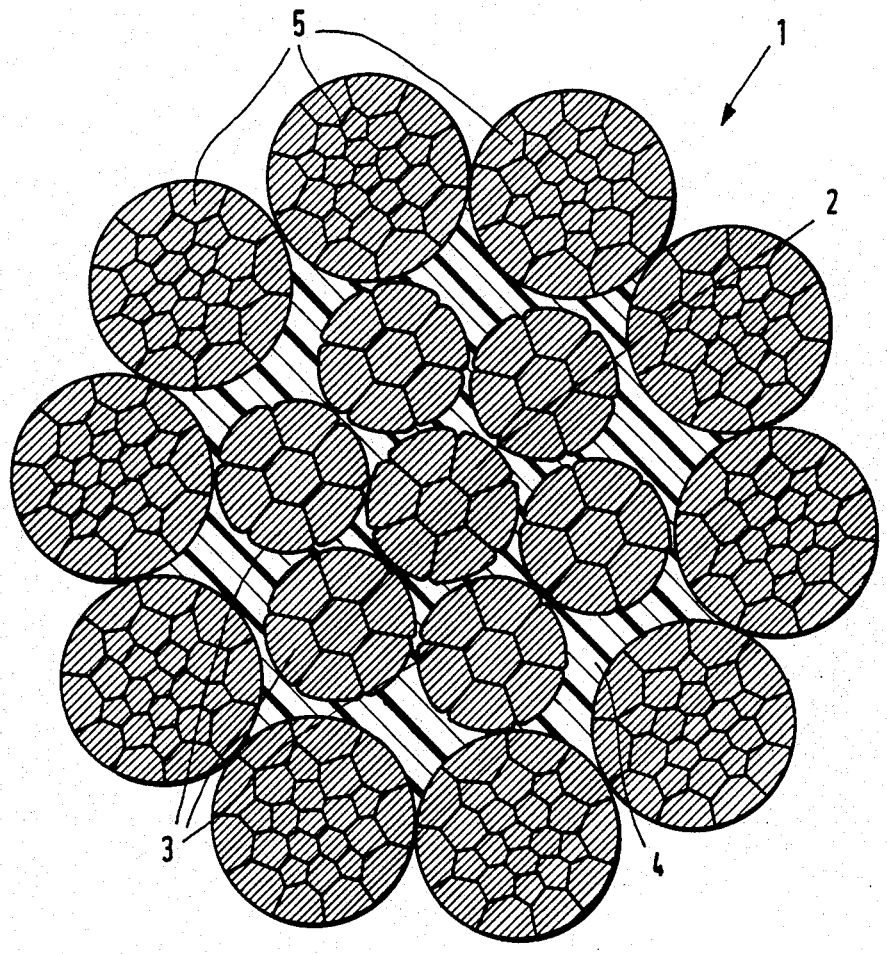
Figure 2:
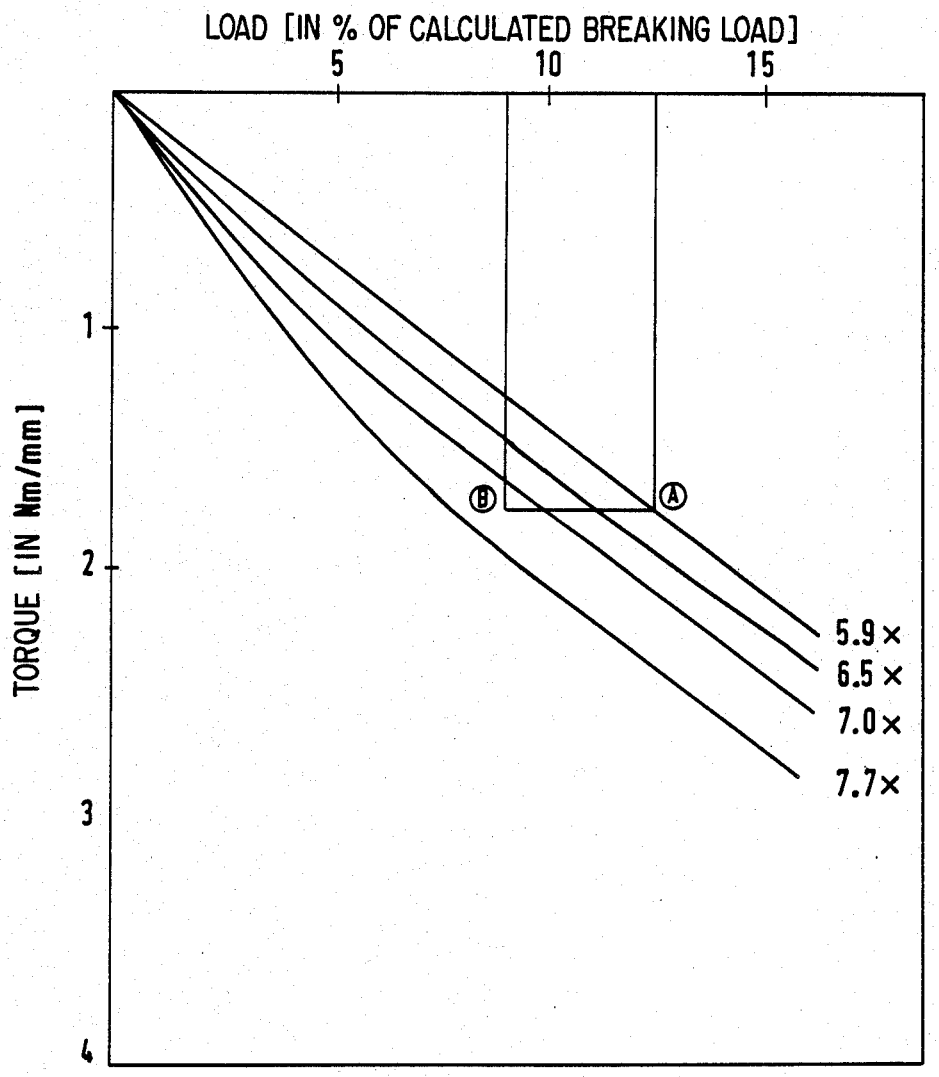
Figure 3:
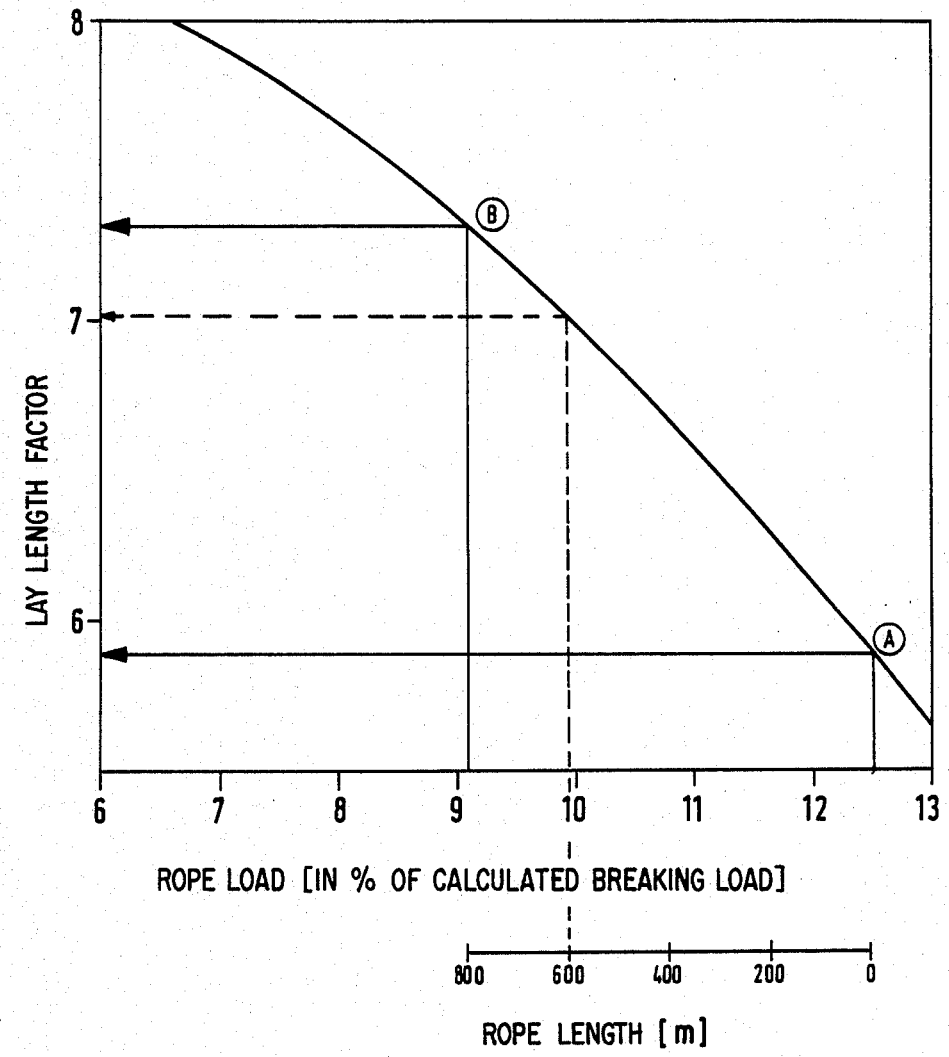
Figure 4:
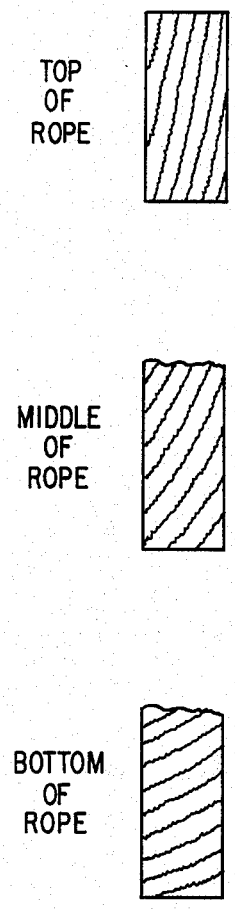
FIG. 4 shows that, in a wire rope with a single layer of strands, the length of lay increases from bottom to top.
Figure 5:
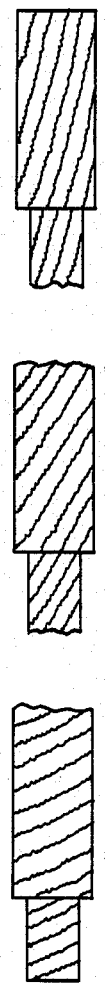
FIG. 5 shows that, in a wire rope with a plurality of strand layers each having the same direction of lay, the length of lay of the outermost layer, and preferably also of at least the next layer, increases from bottom to top.
Figure 6:
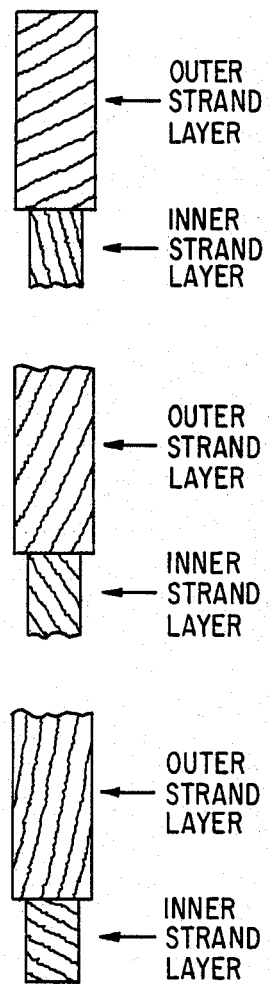
FIG. 6 shows that, in a wire rope with an outer strand layer and an adjacent inner strand layer having opposite directions of lay, the length of lay of the outer layer decreases from bottom to top and vice versa for the inner layer.

I claim:

1. A rope, particularly a mining cable, marine cable or suspension cable, having first and second ends, said rope comprising a load-bearing portion which extends from said first end to said second end, and said load-bearing portion having a length of lay which varies in a direction from said first end towards said second end in such a manner that the twisting moment generated in said rope per unit load decreases in a direction from said first end towards said second end.

2. The rope of claim 1, said rope having a section which extends between a first location nearer said first end and a second location nearer said second end; and wherein said rope is designed such that, when said rope is suspended with said second end above said first end, the decreases in twisting moment from said first location to said second location due to variation in length of lay substantially equals the increase in twisting moment from said second location to said first location due to the weight of said section.

3. The rope of claim 1, wherein said rope has a single layer of strands, said layer having a length of lay which increases in a direction from said first end towards said second end.

4. The rope of claim 1, wherein said rope includes a first layer of strands and a second layer of strands adjacent to, and surrounded by, said first layer, said layers having the same direction of lay, and the length of lay of said first layer, and preferably also of said second layer, increasing in a direction from said first end towards said second end.

5. The rope of claim 1, wherein said rope includes a first layer of strands and a second layer of strands adjacent to, and surrounded by, said first layer, said layers having opposite directions of lay, and the length of lay of said first layer decreasing in a direction from said first end towards said second end and/or the length of lay of said second layer increasing in a direction from said first end towards said second end.

6. The rope of claim 1, wherein said rope includes a first layer of strands and a second layer of strands adjacent to, and surrounded by, said first layer, said layers having opposite directions of lay, and each of said strands comprising a plurality of wires, the length of lay of wires in strands of said first layer decreasing in a direction from said first end towards said second end and/or the length of lay of wires in strands of said said second layer increasing in a direction from said first end towards said second end.

7. The rope of claim 1, wherein said rope is designed such that, when said rope is under load, the specific load in the region of said second end is approximately uniform over the cross section of said rope.

8. The rope of claim 1, wherein the length of lay in said load-bearing portion varies in steps.

* * * * *